US008936430B2

(12) United States Patent
Bassett

(10) Patent No.: US 8,936,430 B2
(45) Date of Patent: Jan. 20, 2015

(54) SUBMERSIBLE CENTRIFUGAL PUMP FOR SOLIDS-LADEN FLUID

(75) Inventor: Lonnie Bassett, Missouri City, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 794 days.

(21) Appl. No.: 13/089,942

(22) Filed: Apr. 19, 2011

(65) Prior Publication Data

US 2012/0269614 A1 Oct. 25, 2012

(51) Int. Cl.

| | |
|---|---|
| ***F01D 13/02*** | (2006.01) |
| ***F04D 3/02*** | (2006.01) |
| ***F04D 7/04*** | (2006.01) |
| ***F04D 13/10*** | (2006.01) |
| ***F04D 29/54*** | (2006.01) |

(52) U.S. Cl.

CPC .. *F04D 3/02* (2013.01); *F04D 7/04* (2013.01); *F04D 13/10* (2013.01); *F04D 29/548* (2013.01)

USPC ..... 415/143; 416/175; 416/198 R

(58) Field of Classification Search

USPC ..... 415/121.1, 143, 198.1, 901, 199.2; 416/120, 124, 175, 203, 198 R

See application file for complete search history.

(56) References Cited

U.S. PATENT DOCUMENTS

| | | | | |
|---|---|---|---|---|
| 4,386,653 | A * | 6/1983 | Drake | 166/105 |
| 4,826,393 | A * | 5/1989 | Miki | 415/72 |
| 4,884,943 | A * | 12/1989 | Niskanen | 415/143 |
| 5,091,082 | A | 2/1992 | Yost | |
| 5,133,639 | A * | 7/1992 | Gay et al. | 415/170.1 |
| 5,482,117 | A * | 1/1996 | Kolpak et al. | 166/265 |
| 6,106,224 | A * | 8/2000 | Sheth et al. | 415/104 |
| 6,361,272 | B1 * | 3/2002 | Bassett | 415/121.1 |
| 6,406,277 | B1 | 6/2002 | Shafer et al. | |
| 6,702,027 | B2 * | 3/2004 | Olson et al. | 166/369 |
| 6,723,158 | B2 * | 4/2004 | Brown et al. | 96/214 |
| 7,419,354 | B2 * | 9/2008 | Zamfes | 415/198.1 |
| 7,461,692 | B1 | 12/2008 | Wang | |
| 7,543,633 | B2 * | 6/2009 | Brown et al. | 166/105.5 |
| 7,766,081 | B2 * | 8/2010 | Brown et al. | 166/105.5 |
| 8,397,811 | B2 * | 3/2013 | Reid | 166/265 |
| 2008/0101924 | A1 * | 5/2008 | Orban et al. | 415/199.2 |
| 2008/0292454 | A1 * | 11/2008 | Brunner | 415/199.2 |
| 2009/0272538 | A1 * | 11/2009 | Kennedy | 166/369 |
| 2010/0319926 | A1 | 12/2010 | Reid | |

OTHER PUBLICATIONS

International Search Report and Written Opinion, International Application No. PCT/US2012/033887, 9 pages, Oct. 23, 2012.

International Preliminary Report on Patentability, International Application No. PCT/US2012/033887, mailed Oct. 31, 2013, 5 pages.

* cited by examiner

*Primary Examiner* — Dwayne J White
*Assistant Examiner* — William Grigos
(74) *Attorney, Agent, or Firm* — John W. Wustenberg; Baker Botts L.L.P.

(57) ABSTRACT

A submersible centrifugal pump is disclosed. The submersible centrifugal pump includes a pump housing having a pump intake disposed generally opposite a pump outlet. A shaft extends at least partially through the pump housing and is adapted to be driven by a submersible motor. A centrifugal impeller is attached to the shaft and has an opening for fluid intake. A diffuser is disposed corresponding to the centrifugal impellers to form a pump stage. And an auger is coupled to the shaft.

9 Claims, 3 Drawing Sheets

SUBMERSIBLE CENTRIFUGAL PUMP FOR SOLIDS-LADEN FLUID

BACKGROUND

The present disclosure relates generally to centrifugal submersible pumps and, more particularly, to assemblies and methods for pumping fluids containing solids.

Frequently, an underground pump is used to force fluids toward the surface. An electric submersible pump (ESP) may be installed in a lower portion of the wellbore. There are several problems connected with the downhole pumping of fluid containing solids, such as coal fines or scale from a source such as a coal field or other energy liquid sources. These problems generally result in premature failure of the submerged pump.

One problem is the presence of large coal or other solids particles which flow through the pump and cause damage thereto. Another problem is excessive wear, e.g., in a water-coal slurry environment) due to low fluid velocity resulting from low intake pressure or high solids-to-fluid ratios. Lower volumes and low velocity create areas of pressure drop that allow the solids to drop out and become lodged in the low pressure areas of the pump stage. Compounding that problem is that, with build-up of solids through often tortuous flow-ways of conventional pumps, the increasing build-up may eventually prohibit the pump from producing fluid.

Yet another problem is vapor lock which occurs when the flow of water is too low compared with the amount of gas present. In wells with high volumes of gas, gas separators may also be included, to separate gas from the rest of the produced fluids. The gas may be separated in a mechanical or static separator and vented to the annulus. The remainder of the produced fluid may enter the ESP, which may pump it to the surface via production tubing. In wells producing gas, the ESP may be used to pump water out of the wellbore to maintain the flow of unconventional gas, which may include methane gas, for example. In this instance, the water is pumped up production tubing, while the methane gas flows up the annulus between the production tubing and the wellbore. However, some methane gas entrained in the water will be pumped by the pump. Wells that are particularly "gassy" may experience a significant amount of the methane gas passing through the pump, which may cause gas lock, resulting in costly and time-consuming shutdowns.

SUMMARY

The present disclosure relates generally to centrifugal submersible pumps and, more particularly, to assemblies and methods for pumping fluids containing solids.

In one aspect, a submersible centrifugal pump is disclosed. The submersible centrifugal pump includes a pump housing having a pump intake disposed generally opposite a pump outlet. A shaft extends at least partially through the pump housing and is adapted to be driven by a submersible motor. A centrifugal impeller is attached to the shaft and has an opening for fluid intake. A diffuser is disposed corresponding to the centrifugal impellers to form a pump stage. And an auger is coupled to the shaft.

In another aspect, a pump assembly to pump solids-laden fluid is disclosed. The pump assembly includes a housing having a pump intake disposed generally opposite a pump outlet. A shaft extends at least partially through the pump housing and is adapted to be driven by a submersible motor. A multi-stage compression pump stack is coupled to the shaft. And an auger assembly is coupled to the multi-stage compression pump stack and configured to provide a vortex effect in a fluid.

In yet another aspect, a method for pumping is disclosed. The method includes providing a pump system that includes a pump assembly and a motor configured to drive the pump assembly. The pump assembly includes: a housing having a pump intake disposed generally opposite a pump outlet; a shaft extending at least partially through the pump housing and adapted to be driven by a submersible motor; a multi-stage compression pump stack coupled to the shaft; and an auger assembly coupled to the multi-stage compression pump stack. The pumping system is placed in a wellbore. The motor is powered to actuate the pump assembly. A fluid is allowed to pass into the pump assembly. And a vortex effect is generated in the fluid at least in part with the auger assembly.

Accordingly, certain embodiments according to the present disclosure may provide a centrifugal submersible pump particularly adapted for pumping solids-saturated fluid from a drilled well in any liquid bearing formation to prevent pump plugging and low-velocity issues. Certain embodiments provide for a centrifugal pump having increased overall efficiency in handling solids-entrained fluids by keeping a solid stream of fluid moving under all conditions. Additionally, certain embodiments may improve intake efficiency of the pump in gaseous conditions by having a non-contained area in the lower section of the pump eliminating a tortuous path for fluid and gas. Certain embodiments may reduce the risk of gas locking or vapor locking the centrifugal pump by increasing velocity in the bottom section of the pump. Furthermore, certain embodiments according to the present disclosure may provide for a vortex at or proximate to the discharge portion at the top of the pump, which is prone to plugging due to solids settling out of the produced liquid at the time the pump is not running The features and advantages of the present disclosure will be readily apparent to those skilled in the art. While numerous changes may be made by those skilled in the art, such changes are within the spirit of the invention.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features.

Figure 3:
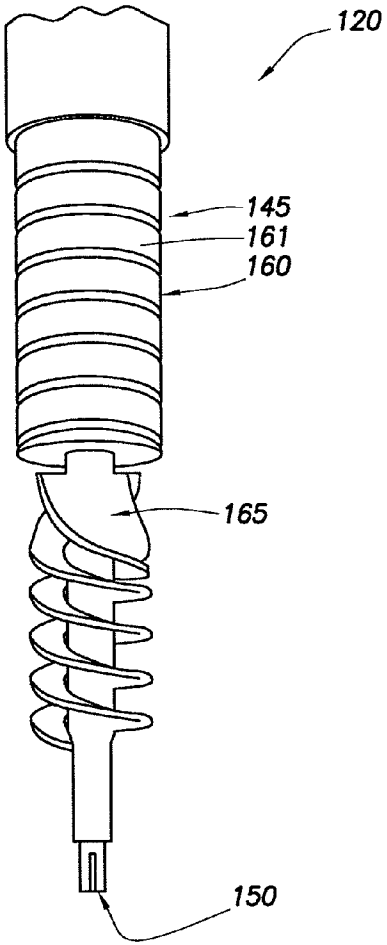
FIG. 3 is a partial side view of a pump, in accordance with certain embodiments of the present disclosure.

While embodiments of this disclosure have been depicted and described and are defined by reference to example embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DESCRIPTION

The present disclosure relates generally to centrifugal submersible pumps and, more particularly, to assemblies and methods for pumping fluids containing solids.

Illustrative embodiments of the present disclosure are described in detail herein. In the interest of clarity, not all features of an actual implementation are described in this specification. It will of course be appreciated that in the development of any such actual embodiment, numerous implementation-specific decisions must be made to achieve developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of the present disclosure. Furthermore, in no way should the following examples be read to limit, or define, the scope of the invention.

Certain embodiments according to the present disclosure may be directed to a submersible pump that may be specifically designed for downhole pumping of solids-laden fluid from wells drilled to recover liquids as a single energy source or liquids in the form of a byproduct to recover some other form of energy. Certain embodiments may include a centrifugal pump configuration that has an electric motor for driving a shaft having centrifugal impellers distributed therealong, each impeller being located adjacent a diffuser, stationary with regard to the pump wall to form a multi-stage pump. Certain embodiments may be useful in the petroleum industry or industrial or municipal water industry, but especially useful for downhole pumping of solids-saturated fluid from wells drilled to produce fluid in the energy or water supply industry and with or without gas in solution.

Certain embodiments may include an auger assembly located in the top, bottom, middle or any combination thereof within the same housing so as to provide a single section pumping device. In certain embodiments, each section can be coupled with other sections to increase dynamic lift to the centrifugal pump as required to meet the volumetric and total dynamic head requirements of each individual well. The auger assembly may be configured to create a contained tight vortex of fluid that keeps solids suspended in the fluid, increasing velocity of the fluid into the eye of the bottom diffuser. This tight vortex or "tornado effect" may keep solids from accumulating and "plugging" the lower stages and, as a result, reduce the amount of abrasive wear.

Figure 1:
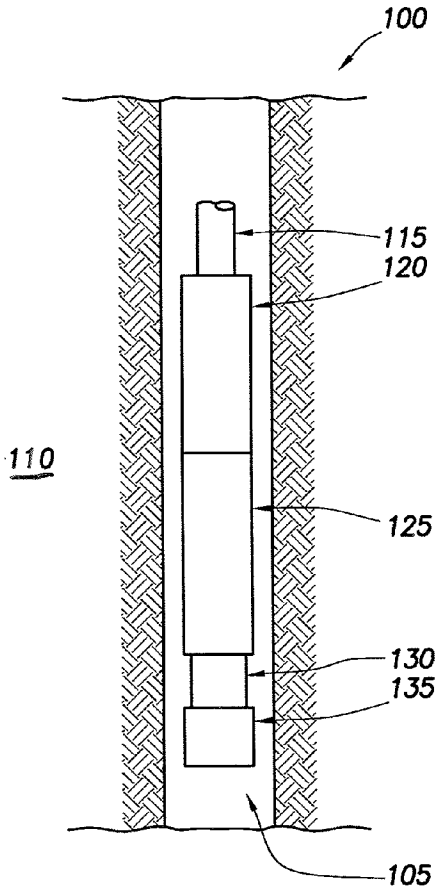
FIG. 1 illustrates a schematic partial cross-sectional view of one example pumping system, in accordance with certain embodiments of the present disclosure.

FIG. 1 illustrates a schematic partial cross-sectional view of one example pumping system 100, in accordance with certain embodiments of the present disclosure. The pumping system 100 may be disposed within a wellbore 105, which may be cased or uncased according to particular implementation, in a formation 110. The pumping system 100 may include a centrifugal pump 120 coupled to an intake section 125, a seal section 130, and a motor section 135. In general, the pumping system 100 may be suspended by a production tubular 115 in a suitable manner known in the art, with a submersible electrical cable extending from a power supply on the surface (not shown) to the motor of the motor section 135. The pump 120 may have one or more intakes in the vicinity of the intake section 125. The pump 120 may have a pump outlet located and attached for flow to a conduit for receiving pumped fluid in the vicinity of an upper end of the pump 120 for connection to a conduit for carrying the fluid to the surface, or into the casing of another submersible pump.

Figure 2:
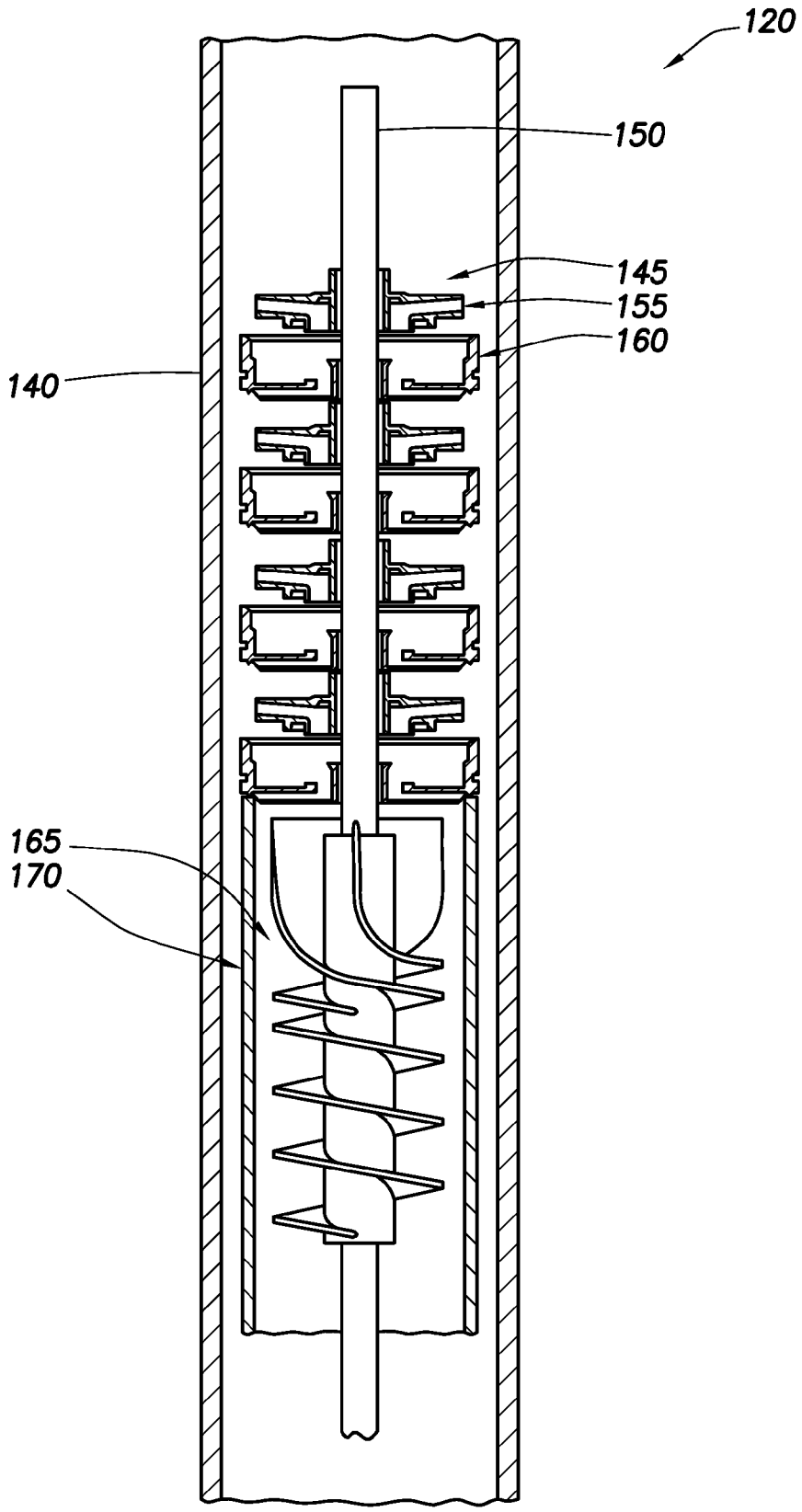
FIG. 2 shows a schematic partial cross-sectional view of a pump 120, in accordance with certain embodiments of the present disclosure.

FIG. 2 shows a schematic partial cross-sectional view of a pump 120, in accordance with certain embodiments of the present disclosure. The pump 120 may include a housing 140 and a central shaft 150 driven by the motor of motor section 135. The housing 140 may be a generally cylindrical pump casing of such diameter as to fit within a well borehole for insertion and removal of the pump 120. The shaft 150 may be an axial drive shaft extending substantially, partially or entirely the length of the pump 120 and adapted to be driven by a submersible motor located above or below the pump 120. The shaft 150 may drive a multi-stage compression pump stack 145. The stages of the multi-stage compression pump stack 145 may be distributed along the shaft 150. Each stage may include a centrifugal impeller 155 and a diffuser 160.

Each impeller 155 may be coupled to the shaft 150 for rotation with the shaft 150. Each impeller 155 may include one or more fluid inlets, which may be axial openings proximate to the shaft 150, and one or more curved vanes to form fluid passageways to accelerate fluid with the rotation the central shaft 150 and to force the fluid toward a diffuser 160 or another portion of the pump 120. In certain embodiments, one or more of the impellers 155 may have central hubs to slidingly engage the shaft 150 and to be keyed for rotation with the shaft 150, and each hub may also extend (not shown) to engage an adjacent diffuser 160. In certain embodiments, one or more of the impellers 155 may be free of any physical engagement with the diffusers 160.

FIG. 3 is a partial side view of a pump 120, in accordance with certain embodiments of the present disclosure. In the example of FIG. 3, one or more of the impellers 155 may disposed within a wall 161 of one or more diffusers 160. Each diffuser 160 may be stationary with respect to the shaft 150 and may, for example, be coupled to the housing 140 or supported by another portion of the pump 120. For example, a diffuser 160 may be supported by inward compression of the housing 140 so as to remain stationary relative to the centrifugal impellers 155, and a diffuser 160 may have a central bore of such diameter as to allow fluid to travel upward through the annulus between said central bore and the shaft 150 and into the impeller intake. In certain embodiments, the diffuser 160 may aid radial alignment of the shaft. Each diffuser 160 may include one or more inlets to receive fluid from an adjacent impeller 150. One or more cylindrical surfaces and radial vanes of a diffuser 160 may be formed to direct fluid flow to the next stage or portion of the pump 120.

The multi-stage compression pump stack 145 may include any number of suitable stages as required by design/implementation requirements. For example, stages may be stacked one upon each other to create a required amount of lift for each well. Certain embodiments may include multiple compression pump stacks. And while certain examples impeller and diffuser configurations are disclosed herein, those examples should not be seen as limiting. Any suitable impeller and diffuser configuration may be implemented in accordance with certain embodiments of the present disclosure.

An auger 165 may be coupled to the shaft 150 any suitable manner to rotate with the shaft 150. By way of example without limitation, the auger 165 may be keyed directly to the shaft 150 with snap rings above and below the auger 165 to assure that it remains solidly in place. The auger 165 may be disposed below the bottom diffuser 160 and directly above intake ports of the intake section 125. While one non-limiting example auger 165 is depicted, that example should not be seen as limiting, and it should be understood that an auger according to embodiments of the present may have varying pitches and lengths, for example, depending on varying well conditions and implementations.

As depicted in FIG. 2, the auger 165 may be disposed in a compression tube 170 that may extend within a length of the housing 140 to form an annulus for fluid flow. In conjunction with the fluid flow, the compression tube 170 may aid in directing fluid from the intake of the pump to the eye of the first impeller or diffuser. The compression tube 170 may be coupled to one or more of the multi-stage compression pump stack 145 and the housing 140. In certain embodiments, the compression tube 170 may be held stationary between a base of the pump 120 and the bottom diffuser 160 so no movement can be made. The compression tube 170 may be made of any material having sufficient abrasion resistance to avoid premature wear. With certain embodiments, the auger system may be installed within the pump, as in the example depicted. However, with certain other embodiments, the auger system may be a separate screw-on or bolt-on device as a pump extension.

In operation, the auger 165 in the compression tube 170 may create a contained tight vortex of fluid that keeps solids suspended in the fluid and increases velocity of the fluid into the eye of a diffuser 160. The auger 165 also may act to break up solids to further facilitate fluid flow. In the non-limiting example depicted, the auger 165 may accelerate fluid into the eye of the bottom diffuser 160. The tight vortex or "tornado effect" provided with the auger 165 may keep solids from stacking up, plugging, obstructing or otherwise inhibiting flow in the lower stages of the multi-stage compression pump stack 145.

As a result, the amount of abrasive wear on the pump 120 may be reduced when pumping solids-laden fluid, as contrasted with conventional pumps. Moreover, with conventional pumps, the path through the stages may be extremely tortuous so that solids are allowed to build up as velocity drops, and increasing solids build-up creates a downward spiral effect until the stack can no longer produce fluid in the conventional pump. Pumps according to certain embodiments of the present disclosure may solve that problem. Additionally, the pump 120 may improve intake efficiency of pumping in gaseous conditions by having a non-contained area in the lower section of the pump eliminating a tortuous path for fluid and gas. Further, the auger 165 may assist in adding additional lift so that sufficient pressure is provided for the pump 120 from below.

Although in the example of FIG. 2, the auger assembly is disposed in a lower portion of the pump 120, that configuration should not be seen as limiting. One or more auger assemblies may be disposed in the top portion, bottom portion, middle portion, or any combination thereof within the same housing to provide of a single section pumping device. For example, multiple auger assemblies may be used in series to handle larger concentrations of solids. In certain embodiments, each pump or auger section can be coupled with other sections to increase dynamic lift to the centrifugal pump as required to meet the volumetric and total dynamic head requirement of each individual implementation.

In certain alternative embodiments, an auger 165, with or without compression tube 170, may be disposed in an upper portion of the pump 120 to create a vortex effect at or proximate to the discharge portion of the pump 120. This vortex effect may especially useful in handling solids that may have previously settled out of produced fluid when the pump 120 was not running, for example. Following restart of the pump 120, the vortex effect created may draw solids off the top stages of the multi-stage compression pump stack 145 by "stirring the solids" and suspending them once again so the pump pressure and velocity can again lift the solids into the tubing column, thereby allowing the fluid to move the solids.

A conventional pump, by contrast, may be typically prone to plugging, due to solids that have settled out of the produced liquid when the pump has ceased running The solids may drop down onto the top several stages (impeller and diffuser) and partially or totally block the vanes of the stage. Such blocking reduces the amount of fluid that can move and reduces the velocity of the fluid.

The auger assembly may be implemented in either a compression design or a floater design, in accordance with certain embodiments of the present disclosure. FIG. 4A shows a schematic partial cross-sectional view of one example compression pumping system 400A, in accordance with certain embodiments of the present disclosure. As depicted, the compression pumping system 400A may include a compression pump 420A, a seal section 430, and a motor section 435. Impellers 455A may be fixed to a shaft 450A or locked to the shaft 450A so they cannot move up or down regardless of the rate at which the pump 420A is producing. One or more augers 465 may be coupled to the shaft 450A above and/or below the impellers 455A. Because the impellers 455A are locked to the shaft 450A, the compression pumping system 400A has an optimum amount of free space through the stack of stages, making it easier to pass solids regardless of the amount fluid being produced.

In certain embodiments according to the present disclosure, the auger assembly may be supported by a tungsten carbide bearing assembly for support. For example, FIG. 4A depicts a motor seal thrust bearing 475, in addition to the motor thrust bearing 480. The motor seal thrust bearing 475 may carry the thrust transferred through the auger assembly and may include tungsten carbine. Tungsten carbide is an abrasion resistant metal that is much harder than coal fines and or sand. It also may be used as bearing material with a bearing assembly 485, a set of sleeve and bushing, installed below and above the auger 465 for radial support.

Figure 4B:
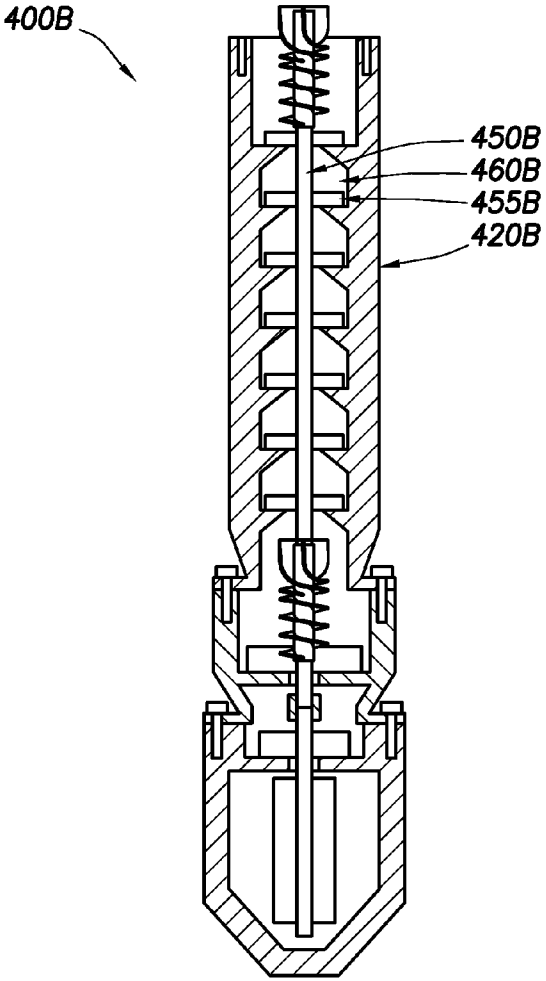
FIG. 4B shows a schematic partial cross-sectional view of one example floater pumping system, in accordance with certain embodiments of the present disclosure.
Figure 4A:
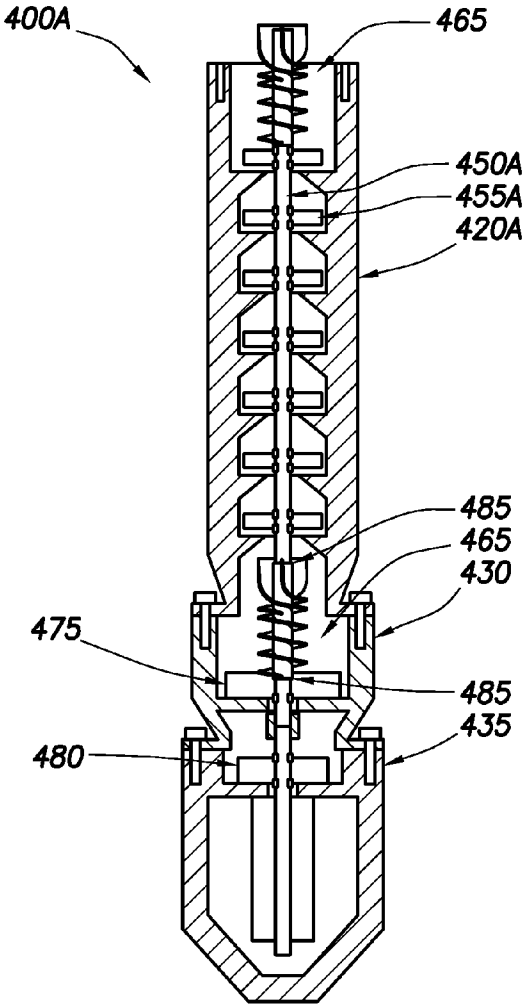
FIG. 4A shows a schematic partial cross-sectional view of one example compression pumping system, in accordance with certain embodiments of the present disclosure.

FIG. 4B shows a schematic partial cross-sectional view of one example floater pumping system 400B, in accordance with certain embodiments of the present disclosure. As depicted, the floater pumping system 400B may include a floater pump 420B, as well as elements similar to those of compression pumping system 400A. In the floater pump 420B, impellers 455B are free to slide up and down the shaft 450B depending on the amount of fluid that is being produced. When low amounts of fluid are produced, an impeller 455B can ride down on a corresponding diffuser 460B. When higher volumes of fluid are produced, an impeller 455B can ride up against the diffuser 460B on top and can cause the impeller 455B to ride in up-thrust.

Accordingly, certain embodiments according to the present disclosure may provide a centrifugal submersible pump particularly adapted for pumping solids-saturated fluid from a drilled well in any liquid bearing formation to prevent pump plugging and low-velocity issues. Certain embodiments provide for a centrifugal pump having increased overall efficiency in handling solids-entrained fluids by keeping a solid stream of fluid moving under all conditions. Additionally, certain embodiments may improve intake efficiency of the pump in gaseous conditions by having a non-contained area about the auger in the lower section of the pump eliminating a tortuous path for fluid and gas. The auger is open from bottom to top which will not restrict fluid flow as do the tortuous paths of the impellers and diffusers. Certain embodiments may reduce the risk of gas locking or vapor locking the centrifugal pump by increasing velocity in the bottom section of the pump. Furthermore, certain embodiments according to the present disclosure may provide for a vortex at or proximate to the discharge portion at the top of the pump, which is prone to plugging due to solids settling out of the produced liquid at the time the pump is not running Even though the figures depict embodiments of the present disclosure in a particular orientation, it should be understood by those skilled in the art that embodiments of the present disclosure are well suited for use in a variety of orientations. Accordingly, it should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. The indefinite articles "a" or "an", as used in the claims, are defined herein to mean one or more than one of the element that it introduces. Also, the terms in the claims have their plain, ordinary meaning unless otherwise explicitly and clearly defined by the patentee.

What is claimed is:

1. A submersible centrifugal pump comprising:

a pump housing having a pump intake disposed generally opposite a pump outlet;

a shaft extending at least partially through the pump housing and adapted to be driven by a submersible motor;

a centrifugal impeller attached to the shaft and having an opening for fluid intake;

a diffuser disposed corresponding to the centrifugal impeller to form a pump stage; and an auger coupled to the shaft and housed inside a compression tube disposed within the pump housing, wherein the auger is disposed between the diffuser and the pump outlet.

2. The submersible centrifugal pump of claim 1, wherein the auger is disposed in a tube that forms an annulus for fluid flow.

3. The submersible centrifugal pump of claim 1, wherein the auger is configured to unsettle solids in a fluid between the diffuser and the pump outlet.

4. The submersible centrifugal pump of claim 1, wherein the auger is built in either a compression design or a floater design.

5. The submersible centrifugal pump of claim 1, wherein the auger is supported by a tungsten carbide bearing.

6. A pump assembly to pump solids-laden fluid, the pump assembly comprising:

a housing having a pump intake disposed generally opposite a pump outlet;

a shaft extending at least partially through the pump housing and adapted to be driven by a submersible motor;

a multi-stage compression pump stack coupled to the shaft; and an auger assembly coupled to the multi-stage compression pump stack, housed inside a compression tube disposed within the pump housing, and configured to provide a vortex effect in a fluid, wherein the auger assembly is between the multi-stage compression pump stack and the pump outlet.

7. The pump assembly of claim 6, wherein the auger assembly is built in either a compression design or a floater design.

8. The pump assembly of claim 6, wherein the auger assembly comprises a tungsten carbide bearing.

9. A method for pumping comprising:

providing a pump system comprising:

a pump assembly comprising:

a housing having a pump intake disposed generally opposite a pump outlet;

a shaft extending at least partially through the pump housing and adapted to be driven by a submersible motor;

a multi-stage compression pump stack coupled to the shaft; and an auger assembly coupled to the multi-stage compression pump stack and housed inside a compression tube disposed within the pump housing, wherein the auger assembly is between the multi-stage compression pump stack and the pump outlet; and a motor configured to drive the pump assembly;

placing the pumping system in a wellbore;

powering the motor to actuate the pump assembly;

allowing a fluid to pass into the pump assembly; and generating a vortex effect in the fluid at least in part with the auger assembly, wherein the vortex effect is between the multi-stage compression pump stack and the pump outlet.

* * * * *